United States Patent [19]

Taragna et al.

[11] Patent Number: 4,605,138

[45] Date of Patent: Aug. 12, 1986

[54] BOTTLE CAP

[75] Inventors: Luigi Taragna, Rome; Antonio Giovannelli, Anzio, both of Italy

[73] Assignee: Italcaps S.p.A., Aprilia, Italy

[21] Appl. No.: 719,472

[22] Filed: Apr. 3, 1985

[30] Foreign Application Priority Data

May 16, 1984 [IT] Italy ..... 48205 A/84

[51] Int. Cl.[4] ..... B65D 41/42

[52] U.S. Cl. ..... 215/254

[58] Field of Search ..... 215/254

[56] References Cited

U.S. PATENT DOCUMENTS

| | | | |
|---|---|---|---|
| 3,963,140 | 6/1976 | Harding | 215/254 |
| 3,974,931 | 8/1976 | Moller | 215/254 |
| 4,256,233 | 3/1981 | Harding | 215/254 |

*Primary Examiner*—Donald F. Norton

*Attorney, Agent, or Firm*—Cushman, Darby & Cushman

[57] ABSTRACT

A bottle cap of the tear-off type, particularly an easy-to-open cap for wide mouth bottles, in which a central top wall which covers the top portion of the mouth of the bottle is connected to a lateral band which surrounds the opening of the neck of the bottle and is bent under the edge of the neck to grip the cap, while a tear-off tab, bounded by one or more score lines, extends from the top wall through the lateral band and an angular sealing gasket is interposed between the mouth of the bottle and the top wall and the lateral band, respectively. The score line or lines are carried out approximately at the boundary line between the top wall and the lateral band and the angular sealing gasket is bonded to the innermost surface of the lateral band at a bond area outside the score line or lines, whereby, when the cap is broken by lifting the central top wall by means of the tear tab, the residual lateral bond appears L shaped and the angular sealing gasket is broken only at the tear tab.

The sealing gasket can also be bonded to the top wall at an extension of the bond area, bounded by the score line or lines towards the lateral bond, to make the breaking of the sealing gasket itself along with the tear tab easier at the time the opening of the cap is started.

5 Claims, 3 Drawing Figures

BOTTLE CAP

DESCRIPTION

The present invention refers to a bottle cap and more particularly to an easy-to-open tear-off cap for the use with bottles having a neck with a mouth relatively wide in diameter.

A number of types of tear-off caps of this kind are known, having a top wall connected to a lateral band or skirt, which surrounds the opening of the neck of the bottle and is bent under the edge of the neck to grip the cap. As a sealing element between the bottle and the cap, a sealing ring or sealant is provided, located between the cap itself, generally metallic made from an aluminium alloy, and the edge of the mouth of the bottle.

For the opening of such caps a tear-off tab is provided, carried out as an extension, towards the outside, of an area of the lateral band, whereas one or more score lines, generally two, are carried out in various ways both on the lateral band and on the top wall in order to make the opening operation easier.

In fact, the main drawback of previously known caps has been difficulty in opening, particularly in the case of wide mouth bottles, as opening involves breaking the metal and generally the sealing by means of a tearing action which is carried out by the user with noticeable strains applied to the tear tab with one hand, while with the other hand he holds the bottle and opposes the reactions due to such strains.

Since the strains and the reactions are noticeable, particularly due to the grip effect of the lateral band of the cap on the edge of the mouth of the bottle, in the case of the wide mouth bottles, the risk of the liquid leaking out and also of the bottle overturning is great.

This grip effect is generally further enhanced by the presence of the sealing ring or sealant, generally angular in cross-section, which is part of the cap itself, to which it adheres generally along all its surface of contact with the metal. The sealing ring is so placed in order to avoid both separation during the handling of the cap until the closure of the bottle, and possible escape paths of the carbonatation of the enclosed drinks, and forms a seal gasket compressed between the glass and the metal upon the gripping of the cap.

This seal gasket further has the drawback of easily getting stuck to the mouth of the bottle, especially in the case in which the bottled product contains a percentage of sugar, which, by solidifying, acts as a glue.

Therefore, due to the effect of this bonding action of the sealing gasket, but especially due to the residual grip, that is the grip that the cap portion, generally C shaped, still in contact with the mouth of the bottle exercises on the edge of the mouth itself due to the gripping action provided on the cap upon its application to the bottle, the tearing force needed to ensure the separation of the cap from the bottle can become very high, as far as in the range of some kilograms.

In order to try to eliminate or at least to partially reduce this drawback, a number of attempts have been carried out.

For instance, in the U.S. Pat. No. 2,068,444 it was suggested to reduce the residual gripping effect by making use of circular score lines more or less concentric with the mouth of the bottle and located towards the periphery of the top wall of the cap.

Elsewhere it has been tried to act on the form or on the breaking way of the sealing gasket, but in all the solutions until now available, the residual gripping effect and the bonding of the sealing is not obviated. However where this drawback is reasonably solved, the proposed embodiment does not allow the tightness of the highest pressures required in the case of bottling highly carbonated drinks or drinks to be subjected to the operation of pasteurization.

Therefore, the main object of the present invention is to provide a bottle cap, particularly for wide mouth bottles, having an easy-to-open feature which allows to avoid the leaking out of the liquid on opening the bottle.

A further object is to carry out such a cap in a simple and cheap way, suitable for mass production.

The bottle cap according to the present invention is characterized in that the score line or lines are carried out approximately at the bound line between the top wall and the lateral band and the angular sealing gasket is bonded to the innermost surface of the lateral band at a bond area outside the score line or lines, whereby, when the cap is broken by lifting the central top wall by means of the tear tab, the residual lateral band appears L shaped and the angular sealing gasket is broken only at the tear tab.

The angular sealing can furthermore be bonded to the top wall at an extension of the bond area, bounded by the score line or lines towards the lateral band, to make the breaking of the sealing gasket itself along with the tear tab easier at the time the opening of the cap is started.

Therefore, with the present cap, one achieves the advantage that the opening is made easier by the fact that, on one hand, the sealing gasket is broken only at the tear tab and, to cause the release of the grip action of the lateral band on the edge of the bottle, one relies on the fact that the breaking of the cap takes place along the boundary line betweeen the top wall and the lateral band, giving rise to an L shaped residual band, which does not grip the edge of the neck of the bottle, all this without being detrimental to the internal pressure tightness at the highest usual limits.

In the following, the present invention will be further clarified from the description of one form of practical embodiment of the bottle cap, the description made in a purely illustrative and not limitative way, with reference to the accompanying drawing, in which.

Figure 1:
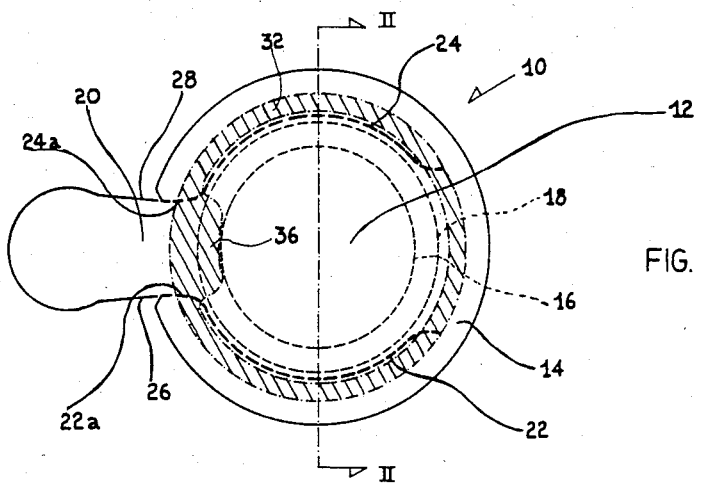
FIG. 1 is a top plan view of a blank of a bottle cap according to the present invention.

With reference to the accompanying drawing, and particularly to FIG. 1 thereof, it is seen that the present cap is carried out starting from a blank 10, made from a metallic material, preferably from aluminium. The blank 10 comprises an innermost central portion 12, designed to form the central top wall of the cap. The central portion 12 is surrounded by an outermost peripheral portion 14, designed to form the lateral band or skirt which extends, in the use of the cap, on the lateral outermost part of the mouth of the bottle.

By means of broken lines 16, 18 there is just shown the position that the uppermost surface of the mouth of the bottle will take on when the cap will be put at work, a bending of the blank 10 being carried out approximately along the outermost line 18 of the mouth at a working stage subsequent to that shown in FIG. 1.

A tear-off tab 20 extends radially with respect to the peripheral band 14 and is separated from it by two score lines 22 and 24, which start at the lateral edges 26 and 28 of the tab 20 and go on parallel to the mouth of the bottle and approximately at its maximum diameter, shown by the broken line 18, i.e. of the boundary line between the top wall 12 and the lateral band 14.

Figure 2:
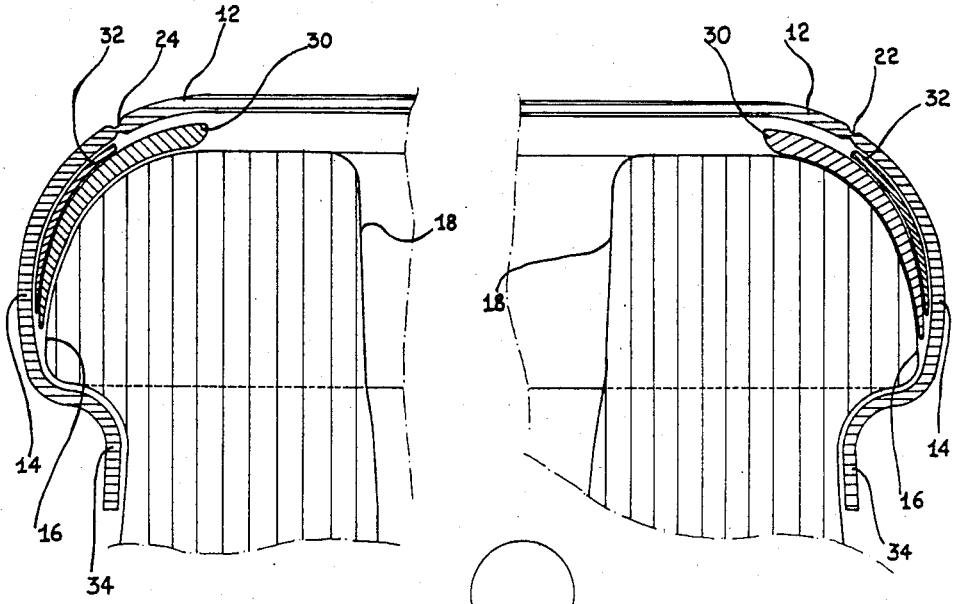
FIG. 2 is a cross-section view of a cap made out from the blank of FIG. 1 and applied on the mouth of a bottle.

With reference now to the FIG. 2, it is seen that, after the complete forming of the cap, an angular sealing gasket 30 is arranged inside the cap and is bonded or anyway made to stick at a bond area 32, shown by hatching in FIG. 1, on the lateral band 14, outside the two score lines 22 and 24.

When the cap is applied on the bottle, the gripping of the lateral band 14 at its lowermost part 34 causes the cap, the sealing gasket and the mouth of the bottle to forcedly come together, assuring the perfect pressure tightness even in the presence of little irregularities and thus the perfect preservation of the pressure existing in the bottle at the moment of the bottle filling.

By means of any one of the well known techniques of bonding reserved to localized areas, the bonding between the angular sealing gasket and the cap is limited to the already cited bond area 32, which extends along the innermost surface of all the outer band 14, including the area of the lateral band bounded by the segments **22*a* and 24*a* of the score line 22 and 24, respectively. Furthermore, the angular sealing gasket 30 can be bonded at an extension 36, going to the inside, of the bond area 32, between the two score lines 22*a* and 24*a***.

Of course, the bond area can be limited to one or more parts of the entire 360 degree ring of the lateral band 14.

On the contrary, the angular sealing gasket 30 is in the most accurate way kept free from bonding to the undersurface of the central top wall 12, in case except for the extension 36; in other words, it is arranged so that the central top wall 12 can be separated from the angular sealing gasket 30 without any effort.

Figure 3:
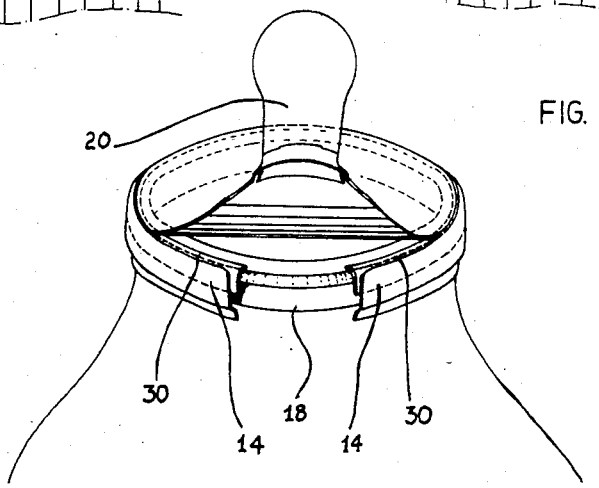
FIG. 3 is a perspective view and shows the present cap in a partial opening stage.

Upon the opening of the bottle by means of the tear of the cap according to the present invention, the angular sealing gasket 30 is only broken at the tear tab 20 at the time the opening is started, as it is well shown in FIG. 3, whereas the top wall 12 can be lifted in a particularly soft and jerk-free way to uncover the mouth of the bottle, because the strain of tearing the sealing gasket after the initial tear-off stage is avoided, with consequent increased ease of use by the consumer.

Furthermore, it is pointed out that, proceeding further on to the tear of the cap, the breaking of the cap at the boundary area between the central top wall and the lateral band weakens the grip of the two residual portions of the lateral band 14 on the mouth of the glass.

In such a way, the coming off action of the cap from the bottle is carried out with a minimum of strain and without stumbling and jerking.

As already stated, the sugar residues of the bottled drinks tend to bond the sealing gasket against the mouth of the bottle, making it even more difficult the operation of removal of the cap from the bottle.

With previously known caps, the action of removal thereof from the mouth of the bottle only relied on a noticeable manual strain needed to move away the generally C shaped lateral bands still gripping the opening of the bottle, such moving away being needed to overcome the maximum diameter of the mouth with the cap according to the present invention, however, the mechanical moving away of the bands which are still gripping is made easier by that the residual lateral band is L shaped, and not C shaped as is usual, and therefore it does not grip the mouth of the bottle.

Obviously, the score lines can be carried out in various ways, for instance on the innermost or the outermost surface of the cap, naturally respecting the principle of not bonding the sealing to the top wall, and leaving, after the tear, an L shaped lateral band, what renders the lateral band easily disengageable from the edge of the neck of the bottle, making a soft and jerk-free opening of the bottle possible.

Although in the present description reference has always been made to wide mouth glass bottles, it is clear that caps according to the present invention can be used for the closure of any type of container having a mouth to be closed, independently from the material, of which the container is made and from the kind of matter packed inside it.

It is obvious that other numerous and different changes and modifications can be performed by those skilled in the art, on the above described embodiment of the present invention, without departing from its scope. It is intended therefore that all these changes and modifications are encompassed in the field of the invention.

We claim:

1. A bottle cap, of the tear-off type in which a central top wall which covers the top portion of the mouth of the bottle is connected to a lateral band which surrounds the opening of the neck of the bottle and is bent under the edge of the neck to grip the cap, and a tear-off tab, bounded by score lines, extends from the top wall through the lateral band and an angular sealing gasket interposed between the mouth of the bottle and the top wall and between the lateral band and the bottle mouth, said cap being characterized in that the score lines are located approximately at the boundary line between the top wall and the lateral band and said angular sealing gasket is bonded to the innermost surface of the lateral band at a bond area outside the score lines, whereby, when the cap is broken by lifting the central top wall by means of the tear-off tab, the residual lateral band appears L shaped and the angular sealing gasket is broken only at the tear tab.

2. A bottle cap as in claim 1, characterized in that said angular sealing gasket is also bonded to the top wall at an extension of the bond area, bounded by the score lines towards the lateral band, to make the breaking of the sealing itself along with the tear tab easier at the time the opening of the cap is started.

3. A bottle cap as in claim 1, characterized in that said score lines are located, at least for a part of their path, at the boundary edge between the central top wall and the lateral band.

4. A bottle cap as in claim 1, characterized in that said score lines, starting from the tear-off tab, first cross at right angles the lateral band and then are gradually connected to the part located at the boundary edge between the central top wall and the lateral band.

5. A bottle cap as in claim 1, characterized in that said score lines extend at least partially into said lateral band.

* * * * *